US005302112A

United States Patent [19]

Nabors, Jr. et al.

[11] Patent Number: 5,302,112

[45] Date of Patent: Apr. 12, 1994

[54] BURNER APPARATUS AND METHOD OF OPERATION THEREOF

[75] Inventors: James K. Nabors, Jr., Apopka; William C. Andrews, Longwood, both of Fla.

[73] Assignee: Xothermic, Inc., Apopka, Fla.

[21] Appl. No.: 45,992

[22] Filed: Apr. 9, 1993

[51] Int. Cl.[5] ..... F23C 5/00

[52] U.S. Cl. ..... 431/8; 431/159; 239/418

[58] Field of Search ..... 431/8, 159; 293/418

[56] References Cited

U.S. PATENT DOCUMENTS 5,217,366 6/1993 Laurenceau ..... 431/159

*Primary Examiner*—Carroll B. Dority

*Attorney, Agent, or Firm*—William M. Hobby, III

[57] ABSTRACT

The disclosed combustor apparatus provides for independent flow streams, one for oxidizer and one for fuel. The adjustable control capability permits various flame configurations and reproducible combustion rates at different oxidizer/gaseous fuel flow rates. The apparatus includes an oxidizer supply which is separated into a primary oxidizer path and a secondary oxidizer path, the flow rate in each of these paths being regulated. The primary oxidizer path and the secondary oxidizer path are combined in an oxidizer channel within a burner block of the burner assembly prior to exiting the burner assembly. Flow may be provided to only one of these paths should that be desired. A recombined oxidizer flow stream, of a non-homogenous velocity cross-section, is thus formed at the exit of the oxidizer channel. The burner apparatus also includes an gaseous fuel supply which is separated into a primary gaseous fuel path and a secondary gaseous fuel path, the flow rate in each of these paths being regulated. The primary gaseous fuel path and the secondary gaseous fuel path are combined in a gaseous fuel channel within the burner block prior to exiting the burner assembly. A recombined gaseous fuel flow stream of a non-homogenous velocity cross-section, is thus formed at the exit of the gaseous fuel channel.

6 Claims, 2 Drawing Sheets

BURNER APPARATUS AND METHOD OF OPERATION THEREOF

BACKGROUND OF THE INVENTION

This invention relates in general to burner units and, more particularly, to burner units which are capable of reducing undesired particulate and gaseous emissions.

The term "burner unit" as used herein refers to a combustor assembly which combines two separate flow streams, namely, a gaseous fuel flow stream and an oxidizer flow stream for combustion purposes. Typical burner units employed in industrial applications today often mix fuel and oxidizer at relatively high velocities. This high velocity mixing technique frequently results in several undesired problems such as increased burner wear and damage, low efficiency, high pollutant production and added maintenance.

Modern approaches to the reduction of pollutant emissions in combustion processes have involved the use of oxygen enrichment. In many cases the increased operating temperatures which result from the increased oxygen content in the oxidizer actually cause an increase in undesired NOX production. The high fuel-oxidizer mixing velocities found in contemporary burners also contribute to high particulate entrainment and high temperature operation. It is noted that these high burner operating temperatures are a significant cause of oxygen-related pollution such as NOX. In oxygen enriched combustion processes using conventional burners, high flame temperatures result in high NOX pollution production because nitrogen which remains after combustion may still react with available oxygen to form undesired NOX compounds at very high rates.

Conventional high temperature burners which operate in an oxygen enriched environment require special materials to enable high temperature operation. Alternatively, these high temperature burners employ extra external cooling to prevent damage to the burner. In either case, the burner unit is made significantly more expensive to enable high temperature operation.

SUMMARY OF THE INVENTION

One object of the present invention is to provide a burner unit which is capable of reducing undesired nitrous oxide and particulate emissions.

Yet another object of the present invention is to provide a burner unit in which the oxidizer/fuel mixing rates can be adjusted to control flame temperatures and duplicate the desired flame over varied operating range.

A further object of the present invention is to provide a burner unit wherein the flame configuration is variable.

Yet another object of the present invention is to provide a burner unit wherein the resultant flame is substantially uniformly formed over its range of operation.

Still another object of the present invention is to provide a burner unit which is self-cooled and which does not require special external cooling structures to prevent damage of the burner unit.

Still another object of the present invention is to provide a burner unit which is comparatively inexpensive to fabricate.

In accordance with the present invention, a burner apparatus for the combustion of a gaseous fuel and an oxidizer is provided. The burner apparatus includes a burner block having first and second opposed burner block faces, the block including an oxidizer channel and a gaseous fuel channel which extend between the first and second burner block faces in a substantially parallel or generally V-like fashion. The oxidizer channel and the gaseous fuel channel are closest together at the first burner block face. The burner apparatus includes a primary oxidizer passageway centrally situated within the oxidizer channel for supplying oxidizer to the oxidizer channel. The burner apparatus also includes a secondary oxidizer passageway situated surrounding the primary oxidizer passageway within the oxidizer channel for supplying oxidizer to the oxidizer channel, the oxidizer exiting the primary oxidizer passageway within the oxidizer channel and combining with the oxidizer from the secondary oxidizer passageway to form a combined primary/secondary oxidizer stream. The burner apparatus further includes a primary gaseous fuel passageway centrally situated within the gaseous fuel channel for supplying gaseous fuel thereto. The burner apparatus still further includes a secondary gaseous fuel passageway situated surrounding the primary gaseous fuel passageway within the gaseous fuel channel for supplying gaseous fuel to the gaseous fuel channel, the gaseous fuel exiting from the primary gaseous fuel passageway within the gaseous fuel channel and combining with the gaseous fuel from the secondary gaseous fuel passageway to form a combined primary/-secondary gaseous fuel stream. The burner apparatus of the invention also includes an oxidizer exit aperture situated in the oxidizer channel at the first burner block face and a gaseous fuel exit aperture situated in the gaseous fuel channel at the first burner block face for permitting the combined primary/secondary oxidizer stream to combine with the combined primary/secondary gaseous fuel stream adjacent the first burner block face to cause combustion.

BRIEF DESCRIPTION OF THE DRAWINGS

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1:
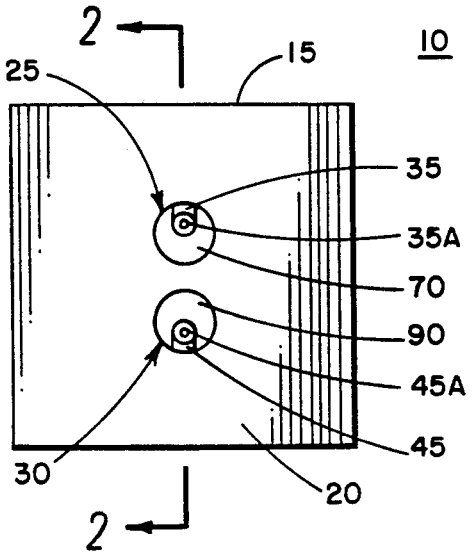
FIG. 1 is a side view of the burner assembly of the present invention showing the burner block portion thereof.

FIG. 1 shows a side view of the burner apparatus of the present invention as burner assembly 10. Burner assembly 10 includes a burner block 15, the exit face 20 of which is depicted in FIG. 1. Exit face 20 is alternatively referred to as exit side 20 and is the side of burner block 15 through which the flame is projected. In one embodiment, burner block 15 is fabricated from a metallic material such as stainless steel or a nonmetallic material such as refractory material, for example. For simplicity in FIG. 1, those portions of burner assembly 10 rearward of burner block 15 are not shown. In this particular embodiment, exit face 20 of burner block 15 includes an oxidizer exit aperture 25 and a gaseous fuel exit aperture 30.

Figure 2:
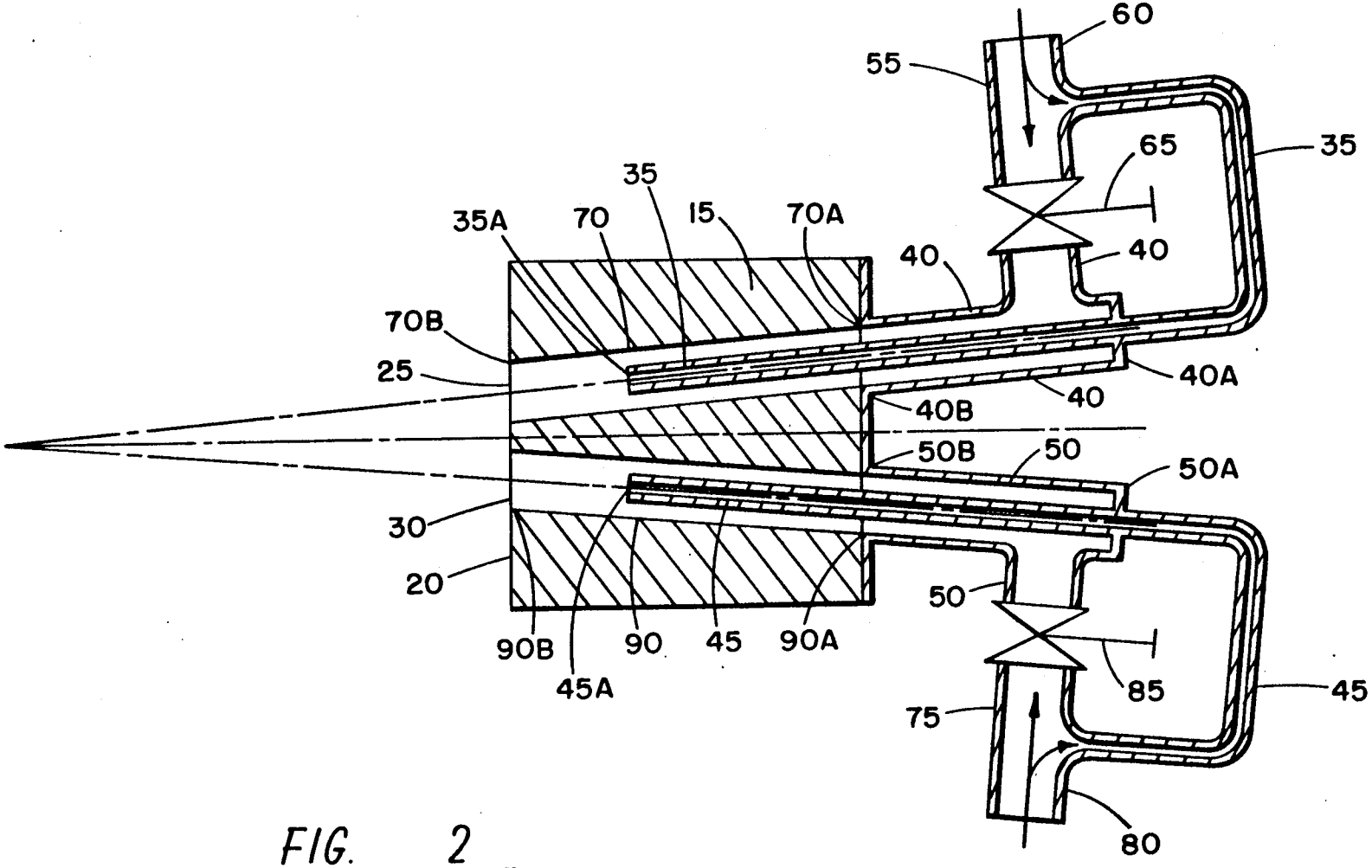
FIG. 2 is a cross section of burner assembly of FIG. 1 taken along section line 2—2.

Burner assembly 10 is more clearly shown in FIG. 2 which is a cross section of burner assembly 10 taken along section line 2—2 of FIG. 1. An oxidizer primary conduit 35 and an oxidizer secondary conduit 40 are situated within burner assembly 10. An end 35A of oxidizer primary conduit 35 is visible though aperture 25 in FIG. 1. The conduits employed in burner assembly are fabricated from stainless steel in one embodiment of the invention. Returning to FIG. 2, a gaseous fuel primary conduit 45 and a gaseous fuel secondary conduit 50 are situated within burner block 15. An end 45A of gaseous fuel primary conduit 45 is also visible though aperture 30 in FIG. 1.

Returning again to FIG. 2, burner assembly 10 includes an oxidizer inlet pipe 55 into which an oxidizer is introduced at oxidizer inlet 60. Oxidizer inlet pipe 55 is joined to oxidizer primary conduit 35 as shown. Oxidizer inlet pipe 55 is coupled to oxidizer secondary conduit 40 by oxidizer balancing valve 65 which can be adjusted to control the oxidizer flow into oxidizer primary conduit 35 and oxidizer secondary conduit 40.

Oxidizer secondary conduit 40 includes an end 40A though which oxidizer primary conduit 35 centrally passes. As seen in FIG. 2, the portion of oxidizer primary conduit 35 which passes through oxidizer secondary conduit 40 is concentric therewith. The inner diameter of oxidizer secondary conduit 40 is larger than the outer diameter of oxidizer primary conduit 35 to permit oxidizer primary conduit 35 to pass concentrically therethrough.

Burner block 15 includes an angled oxidizer channel 70 having an inner diameter substantially equal to the inner diameter of oxidizer secondary conduit 40. Oxidizer channel 70 extends from side to side through burner block 15. Oxidizer channel 70 includes an end 70A which is coupled to oxidizer secondary conduit 40 at end 40B. Oxidizer channel 70 further includes an end 70B which opens onto burner block exit face 20 at oxidizer aperture 25. From FIG. 2, it is seen that oxidizer primary conduit 35 extends throughout the length of oxidizer secondary conduit 40 and through more than half of the length of oxidizer channel 70 in the particular embodiment depicted. Oxidizer primary conduit end 35A is situated within oxidizer channel 70 and adjacent exit aperture 25.

Oxidizer enters oxidizer inlet 60 and flows to oxidizer primary conduit 35 and oxidizer secondary conduit 40 as directed by oxidizer balancing valve 65. The proportioned oxidizer flowing in oxidizer primary conduit 35 and oxidizer secondary conduit 40 partially combines in oxidizer channel 70 and exits burner block 15 at oxidizer exit aperture 25 in exit face 20 where the oxidizer continues to combine.

Burner assembly 10 of FIG. 2 also includes a gaseous fuel inlet pipe 75 into which an gaseous fuel is introduced at gaseous fuel inlet 80. Gaseous fuel inlet pipe 75 is joined to gaseous fuel primary conduit 45 as shown. Gaseous fuel inlet pipe 75 is coupled to gaseous fuel secondary conduit 50 by gaseous fuel balancing valve 85 which can be adjusted to control the gaseous fuel flow into gaseous fuel primary conduit 45 and gaseous fuel secondary conduit 50.

Gaseous fuel secondary conduit 50 includes an end 50A though which gaseous fuel primary conduit 45 centrally passes. As seen in FIG. 2, the portion of gaseous fuel primary conduit 45 which passes through gaseous fuel secondary conduit 50 is concentric therewith. The inner diameter of gaseous fuel secondary conduit 50 is larger than the outer diameter of gaseous fuel primary conduit 45 to permit gaseous fuel primary conduit 45 to pass concentrically therethrough.

Burner block 15 includes an angled gaseous fuel channel 90 having an inner diameter substantially equal to the inner diameter of gaseous fuel secondary conduit 50. Gaseous fuel channel 90 extends from side to side through burner block 15 and is angled with respect to exit face 20 to form a V-shape with respect to oxidizer channel 70. Gaseous fuel channel 90 includes an end 90A which is coupled to gaseous fuel secondary conduit 50 at end 50B. Gaseous fuel channel 90 further includes an end 90B which opens onto burner block exit face 20 at gaseous fuel exit aperture 30. From FIG. 2, it is seen that gaseous fuel primary conduit 45 extends throughout the length of gaseous fuel secondary conduit 50 and through more than half of the length of gaseous fuel channel 90 in the particular embodiment depicted. Gaseous fuel primary conduit end 45A is situated within gaseous fuel channel 90 and adjacent exit aperture 30.

Gaseous fuel enters gaseous fuel inlet 80 and flows to gaseous fuel primary conduit 45 and gaseous fuel secondary conduit 50 as directed by gaseous fuel balancing valve 85. The proportioned gaseous fuel flowing in gaseous fuel primary conduit 45 and gaseous fuel secondary conduit 50 combine in gaseous fuel channel 90 and exit burner block 15 at gaseous fuel exit aperture 30 in exit face 20.

Figure 3:
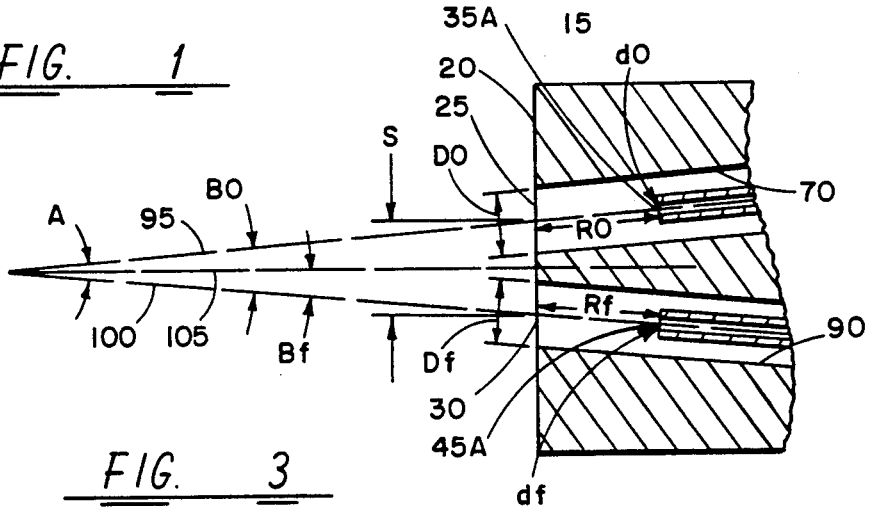
FIG. 3 is a close-up view of a portion of the burner block of the burner assembly.

A close-up view of the portion of burner block 15 close to exit face 20 is shown in FIG. 3. Oxidizer channel 70, which is substantially cylindrical in shape in this particular embodiment, and primary oxidizer conduit 35 have a common centerline or axis 95 which is referred to as oxidizer axis 95. Gaseous fuel channel 90, which is also substantially cylindrical in shape in this particular embodiment, and primary gaseous fuel conduit 45 have a common centerline or axis 100 which is referred to as gaseous fuel axis 100. The oxidizer to gaseous fuel angle A is defined to be the angle between oxidizer axis 95 and gaseous fuel axis 100. It has been found that angle A can vary from zero degrees wherein the oxidizer and gaseous fuel axes are substantially parallel to approximately 90 degrees. Exit spacing S is defined to be the centerline exit spacing between oxidizer exit aperture 25 and gaseous fuel exit aperture 30 as measured parallel to exit face 20.

A centerline or axis 105 is defined horizontally through the center of burner block 15 between oxidizer channel 70 and gaseous fuel channel 90 as shown in FIG. 3. Axis 105 is referred to as burner unit axis 105. $B_o$ is defined to be the angle between oxidizer axis 95 and burner unit axis 105. $B_f$ is defined to be the angle between gaseous fuel axis 100 and burner unit axis 105.

Figure 4:
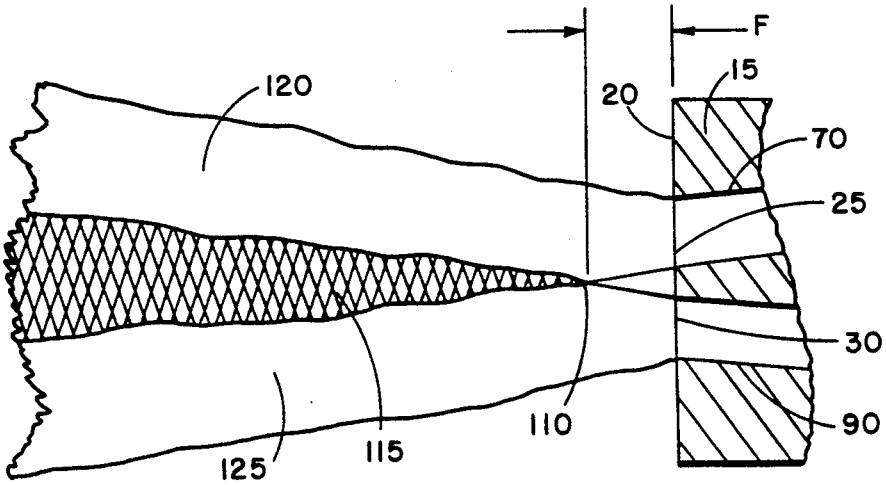
FIG. 4 is a representation of a portion of the burner block assembly adjacent the oxidizer and gaseous fuel exit apertures which shows the combination of oxidizer and gaseous fuel subsequent to exiting these apertures.

Oxidizer leaving oxidizer exit aperture 25 impacts the gaseous fuel leaving gaseous fuel exit aperture 30 at a distance, F, away from exit face 20 as seen in FIG. 4. The impact or mixing strength of the oxidizer with the gaseous fuel is determined by angle A and the respective velocities of the exiting oxidizer and gaseous fuel streams.

FIG. 4 is a representation of a portion of burner block 15 depicting the combination of oxidizer and gaseous fuel subsequent to exiting exit face 20. More particularly, FIG. 4 depicts a typical combustion operation employing the inventive burner unit at an arbitrary burner flow rate and position setting. Impact origin 110 is the point where the oxidizer and gaseous fuel first meet. A more precise definition of distance F, the combustion origin distance, is the perpendicular distance from the burner block exit face 20 to impact origin 110. The combustion origin distance F is mostly dependent on the oxidizer to gaseous fuel angle A and exit spacing S shown in FIG. 3. Oxidizer and gaseous fuel flow rates and velocities contribute only slightly to combustion origin distance F.

The oxidizer weighted average exit velocity is defined to be the average combined velocity at oxidizer exit aperture 25 of the primary oxidizer flow from oxidizer primary conduit 35 and the secondary oxidizer flow which surrounds primary conduit 35 in oxidizer channel 70. The combination of the primary oxidizer flow from oxidizer primary conduit 35 and the oxidizer from oxidizer secondary conduit 40 starts to occur at end 35A of oxidizer primary conduit 35 and continues down oxidizer channel 70 to oxidizer exit aperture 25 and beyond. The further the distance from end 35A, the more combination has occurred between the primary oxidizer flow and the secondary oxidizer flow.

The gaseous fuel weighted average exit velocity is defined to be the average combined velocity at gaseous fuel exit aperture 30 of the primary gaseous fuel flow from gaseous fuel primary conduit 45 and the secondary gaseous fuel flow which surrounds primary conduit 45 in gaseous fuel channel 90. The combination of the primary gaseous fuel flow from gaseous fuel primary conduit 45 and the secondary gaseous fuel flow from gaseous fuel secondary conduit 50 starts to occur at end 45A of gaseous fuel primary conduit 45 and continues down gaseous fuel chamber 90 to gaseous fuel exit aperture 30 and beyond. The further the distance from end 45A, the more combination has occurred between the primary gaseous fuel flow and the secondary gaseous fuel flow.

It should be noted that the term, average velocity, as used above is not a true average, but rather an arbitrary value called weighted average velocity has been used for testing purposes. Weighted average velocity is defined by the following relationship:

$$\text{WEIGHTED } V_{AVG} = \frac{(V_{AVG\ PRIMARY})\, m_{PRIMARY}\, (V_{AVG\ SEC})}{m_{TOTAL}} + \frac{m_{SEC}}{m_{TOTAL}}$$

wherein $V_{AVG\ PRIMARY}$ is defined to be the velocity in primary conduit $V_{AVG\ SEC}$ is defined to be the average velocity in secondary conduit $m_{PRIMARY}$ is defined to be mass flow in primary conduit $m_{SEC}$ is defined to be mass flow in secondary conduit $m_{TOTAL}$ is defined to be mass flow of primary conduit plus the mass flow of secondary conduit In more detail, oxidizer passes through the oxidizer primary conduit 35 to the oxidizer primary conduit end 35A where the resultant primary oxidizer flow combines with the surrounding secondary oxidizer flow which passes through channel 70 from oxidizer secondary conduit 40. The primary and second oxidizer flows are alternatively referred to as the primary and secondary oxidizer streams, respectively. The primary and secondary oxidizer stream rates are adjusted by setting oxidizer balancing valve 65 (FIG. 2) to achieve the desired combination rates or oxidizer weighted average velocity. Combined, the two streams leave burner block 15 at the oxidizer weighted average velocity through oxidizer exit aperture 25.

The oxidizer primary conduit 35 inside diameter is defined as diameter, $d_o$, as shown in FIG. 3. The oxidizer secondary conduit 40 inside diameter is defined as diameter, $D_o$, and substantially equals the diameter of oxidizer channel 70 which is shown in FIG. 3. The primary oxidizer to exit distance, $R_o$, is defined to be the distance from primary oxidizer conduit end 35A to burner block exit face 20 as measured along oxidizer axis 95. It has been found that $R_o$ should typically be no greater than approximately ten times $d_o$. It has also been found that $D_o$ should range from approximately one to approximately sixteen times $d_o$. Ratios varying from those just stated may result in lack of adjustment control.

Gaseous fuel passes through the gaseous fuel primary conduit 45 to the gaseous fuel primary conduit end 45A where the resultant primary gaseous fuel flow combines with the surrounding secondary gaseous fuel flow which passes through channel 90 from gaseous fuel secondary conduit 50. The primary and secondary gaseous fuel stream rates are adjusted by gaseous fuel balancing valve 85 (FIG. 2) to achieve the desired combination rates or gaseous fuel average weighted velocity. The two streams thus combined leave burner block 15 at the gaseous fuel average weighted velocity through the gaseous fuel exit aperture 30.

The gaseous fuel primary conduit 45 inside diameter is defined as diameter, $d_f$, as shown in FIG. 3. The gaseous fuel secondary conduit 50 inside diameter is defined as $D_F$ and substantially equals the diameter of oxidizer channel 90 which is shown in FIG. 3. Ratios of $D_o$ to $D_f$ should range from 0.1 to 10, to 10 to 1. The primary gaseous fuel to exit distance, $R_f$ is defined to be the distance from primary gaseous fuel conduit end 45A to burner block exit face 20 as measured along oxidizer axis 100. It has been found that the distance, $R_f$, should be no greater than approximately ten times $d_f$. It has also been found that the diameter, $D_f$, should range from approximately one to approximately sixteen times $d_f$. Again, ratios varying from those stated may result in lack of adjustment control.

The mixing strength of the oxidizer with the gaseous fuel will determine flame luminosity, shape and stability. Also, the mixing strength of the primary oxidizer flow with the secondary oxidizer flow, and the mixing strength of the primary gaseous fuel flow with the secondary gaseous fuel flow will also determine flame luminosity, shape and stability. All of these factors play a role in efficiency and pollutant generation in the combustion process. By controlling the mixing strength at any particular angle A or flow rate, desired flame appearance and performance can be achieved as discussed in more detail subsequently.

Mixing strengths can be controlled by adjusting the oxidizer or gaseous fuel balancing valves, 65 and 85, respectively. The combined oxidizer flow stream's weighted average velocity and the combined gaseous fuel flow stream's weighted average velocity can thus be manipulated to produce a fast reacting, nonluminous fire or a slow reacting, luminous fire at exit face 20. Once the desired flame is established at a particular oxidizer flow rate and a particular gaseous fuel flow rate, adjustments to balancing valves 66 and 85 can be made to produce similar conditions at other flow rates. For example, if the total oxidizer flow was to be increased, then oxidizer balancing valve 65 would need to be opened sufficiently wider to supply more oxidizer to the oxidizer secondary conduit 40, while decreasing flow to the oxidizer primary conduit 35. The additional diverted oxidizer will maintain the same average weighted velocity as in the previous lower flow rate. This constant average weighted velocity enables similar mixing conditions to exist at different flow rates, thus reproducing desirable combustion performance at any operating flow rate.

The combustion origin distance F is mainly dependent on the oxidizer to gaseous fuel angle A which is variable between zero degrees and ninety degrees, and on exit spacing S which is variable between approximately 0.55 times $D_o$ to approximately 105.5 times $D_o$. The average weighted velocity of the combined oxidizer flow and the average weighted velocity of the combined gaseous fuel flow have little effect on the combustion origin distance, F, but greatly affect the impact region 115. Impact region 115 is the area where combustion occurs as seen in FIG. 4. At a constant angle A, spacing S, oxidizer and gaseous fuel flow rates, the impact region 115 can be made to react quite rapidly, or alternatively, the combustion can be delayed by changing the weighted average oxidizer velocity and the weighted average gaseous fuel velocity. High weighted average oxidizer or gaseous fuel velocities tend to produce fast reacting combustion and a short, non-luminous, conductive type fire at exit face 20. Conversely, low average oxidizer or gaseous fuel velocities result in longer, more luminous slow reacting radiant type fires.

Neither type of fire is acceptable for all types of combustion processes. However, where convection is a primary source of heat transfer, high average velocities are needed, and where radiation is the heat transfer mode, low average velocities are generally desirable. The structure of the burner assembly of the present invention provides variable capabilities for achieving both types of fires. This is made possible by the dual flow technique of the invention wherein primary and secondary oxidizer flow streams are established and wherein primary and secondary gaseous flow streams are established in a manner such that the individual flow rates may be varied according the particular type of fire which is desired.

Figure 5:
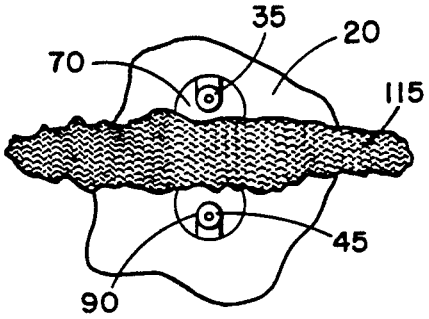
FIG. 5 shows a view of a portion of the exit face of the burner block while combustion is occurring so that the flame or impact region may be observed.

FIG. 5 shows a view of a portion of exit face 20 of burner block 15 so that the flame or impact region 115 may be observed. It is seen that impact region 115 exhibits a relatively thin, but wide profile. This geometry is a result of the impact of the oxidizer and gaseous fuel streams. It has been found that increasing the average velocity of the oxidizer and gaseous fuel streams at exit face 20 will decrease the width of impact region 115. Conversely, decreasing these weighted average velocities will increase the width of the impact region. It is noted that this width variance is with respect to the flow direction and increases toward the downstream direction.

Even though flame lengths, widths and luminosity can be altered, the impact origin 115 remains in the same location regardless of average velocity changes. This fact results in a high degree of flame base stability. Even a small variation in oxidizer to gaseous fuel ratios has little effect on the impact origin location or combustion stability.

It is noted that the introduction of the higher velocity primary oxidizer flow to the center of the slower velocity secondary oxidizer flow in channel 70 tends to stiffen the overall flame which results. It is noted that the introduction of the higher velocity primary gaseous fuel flow to the slower velocity secondary gaseous fuel flow in channel 90 also tends to stiffen the resultant flame.

As seen in FIG. 4, oxidizer region 120 and gaseous fuel region 125, are separated by the impact region 115. This separation not only aids in retarding combustion for low NOX applications, it also enables the oxidizer and gaseous fuel streams to convectively preheat prior to ignition. Particularly with respect to gaseous fuel region 125, intense unreacted exposure to the surrounding heat has been found to dissociate portions of the fuel, producing a more radiant or luminous fire.

It is noted that the burner apparatus can employ multiple gas or oxidizer conveying conduits for maximum operational turndown and velocity control. Additional conduits, for either oxidizer or fuel, can be employed to convey any media as dictated by the particular process. It is also noted the fuel or oxidizer may by preheated when employing the burner apparatus. The burner apparatus of the invention may be employed with in conjunction with other burner apparati. The burner and burner block may fabricated from any materials compatible with the oxidizer, fuel and process. In one embodiment, the operating range of the burner apparatus has been found to be from approximately 0.1 to approximately 100 mmBTU/hr.

While a burner or combustion apparatus has been described above, it is clear that a method of combustion is also provided. More particularly, a method of combustion is provided for a burner assembly having an oxidizer channel, a gaseous fuel channel and an exit face at which the oxidizer channel and the gaseous fuel channel terminate. The oxidizer channel and the gaseous fuel channel each include a central longitudinal axis. The method of combustion includes the steps of providing a supply oxidizer flow stream and then separating the supply oxidizer flow stream into a primary oxidizer flow stream and a secondary oxidizer flow stream. The method also includes the step of regulating the flow of the primary oxidizer flow stream and the secondary oxidizer flow stream. The method further includes the step of injecting the primary oxidizer flow stream into the oxidizer channel such that the primary oxidizer flow stream flows along the central longitudinal axis of the oxidizer channel. The method still further includes the step of injecting the secondary oxidizer flow stream into the oxidizer channel such that the secondary oxidizer flow stream surrounds the primary oxidizer flow stream and recombines with the primary oxidizer flow stream adjacent the exit face to create a recombined oxidizer flow stream.

The method also includes the steps of providing a supply gaseous fuel flow stream and separating the supply gaseous fuel flow stream into a primary gaseous fuel flow stream and a secondary gaseous fuel flow stream. The method further includes the step of regulating the flow of the primary gaseous fuel flow stream and the secondary gaseous fuel flow stream. The method still further includes the step of injecting the primary gaseous fuel flow stream into the gaseous fuel channel such that the primary gaseous fuel flow stream flows along the central longitudinal axis of the gaseous fuel channel. The method also includes the step of injecting the secondary gaseous fuel flow stream into the gaseous fuel channel such that the secondary gaseous fuel flow stream surrounds the primary gaseous fuel flow stream and recombines with the primary gaseous fuel flow stream adjacent the exit face to create a recombined gaseous fuel flow stream. The method further includes the step of combining the recombined oxidizer fuel flow stream with the recombined gaseous fuel flow stream after the recombined oxidizer fuel flow stream and the recombined gaseous fuel flow stream fuel exit the exit face to cause combustion.

The foregoing describes a burner or combustion assembly which reduces undesired particulate and related oxide emissions. The burner assembly is capable of operating at relatively low temperatures or higher temperatures dependent of the particular application. Moreover, a burner assembly is provided wherein the resultant flame is substantially uniformly formed. The burner assembly is advantageously self-cooled and does not require special external cooling structures to prevent damage to the burner unit. In the disclosed burner assembly, the oxidizer/fuel mixing rates can be adjusted to control flame temperatures and the flame configuration is variable. Advantageously, the disclosed burner apparatus is orientation independent and the oxidizer employed therein can be of any proportion or purity. Moreover, multiple fuels may be employed in the disclosed burner apparatus. The burner apparatus also desirably provides flat wide dispersion of combustion for better heat distribution.

While only certain preferred features of the invention have been shown by way of illustration, many modifications and changes will occur to those skilled in the art. It is, therefore, to be understood that the present claims are intended to cover all such modifications and changes which fall within the true spirit of the invention.

We claim:

1. A burner apparatus for the combustion of a gaseous fuel and an oxidizer, said apparatus comprising:

a burner block having first and second opposed burner block faces, said block including an oxidizer channel and a gaseous fuel channel which extend between said first and second burner block faces, said oxidizer channel and said gaseous fuel channel being closest together at said first burner block face;

a primary oxidizer passageway centrally situated within said oxidizer channel for supplying oxidizer to said oxidizer channel;

a secondary oxidizer passageway situated surrounding said primary oxidizer passageway within said oxidizer channel for supplying oxidizer to said channel, the oxidizer exiting said primary oxidizer passageway within said oxidizer channel and combining with the oxidizer from said secondary oxidizer passageway to form a combined primary/-secondary oxidizer stream;

a primary gaseous fuel passageway centrally situated within said gaseous fuel channel for supplying gaseous fuel thereto;

a secondary gaseous fuel passageway situated surrounding said primary gaseous fuel passageway within said gaseous fuel channel for supplying gaseous fuel to said gaseous fuel channel, the gaseous fuel exiting from said primary gaseous fuel passageway within said gaseous fuel channel and combining with the gaseous fuel from said secondary gaseous fuel passageway to form a combined primary/-secondary gaseous fuel steam, and an oxidizer exit aperture situated in said oxidizer channel at said first burner block face and a gaseous fuel exit aperture situated in said gaseous fuel channel at said first burner block face for permitting said combined primary/secondary oxidizer stream to combine with said combined primary/secondary gaseous fuel stream adjacent said first burner block face to cause combustion.

2. A burner apparatus for the combustion of a gaseous fuel and an oxidizer, said apparatus comprising:

a burner block including a burner block face adjacent which combustion occurs and a flame is formed, said burner block further including an oxidizer channel and a gaseous fuel channel, said oxidizer channel having an entrance end and an exit end, said gaseous fuel channel having an entrance end and an exit end, the exit end of said oxidizer channel and the exit end of said gaseous fuel channel being situated at said burner block face, said oxidizer channel and said gaseous fuel channel having a predetermined angle therebetween;

an oxidizer inlet port to which oxidizer is fed;

a gaseous fuel inlet port to which gaseous fuel is fed;

an oxidizer balancing valve and a gaseous fuel balancing valve;

a primary oxidizer conduit for transferring oxidizer into said oxidizer channel, said primary oxidizer conduit being coupled to said oxidizer inlet and having an end extending into said oxidizer channel from the entrance end of said oxidizer channel, said primary oxidizer conduit having an outer diameter less than the inner diameter of said oxidizer channel;

a secondary oxidizer conduit for transferring oxidizer into the entrance end of said oxidizer channel, said oxidizer balancing valve being coupled between said oxidizer inlet and said secondary oxidizer conduit to provide a regulated amount of oxidizer to said secondary oxidizer conduit;

a primary gaseous fuel conduit for transferring gaseous fuel into said gaseous fuel channel, said primary gaseous fuel conduit being coupled to said gaseous fuel inlet and having an end extending into said gaseous fuel channel from the entrance end of said gaseous fuel channel, said primary gaseous fuel conduit having an outer diameter less than the inner diameter of said gaseous fuel channel, and a secondary gaseous fuel conduit for transferring gaseous fuel into the entrance end of said gaseous fuel channel, said gaseous fuel balancing valve being coupled between said gaseous fuel inlet and said secondary gaseous fuel conduit to provide a regulated amount of gaseous fuel to said secondary gaseous fuel conduit, whereby oxidizer from said primary oxidizer conduit and oxidizer from said secondary oxidizer conduit recombine combine adjacent the exit end of said oxidizer channel, and gaseous fuel from said primary gaseous fuel conduit and gaseous fuel from said secondary gaseous fuel conduit recombine adjacent the exit end of said gaseous fuel channel, to exit said burner block face and mix to cause combustion.

3. The apparatus of claim 2 wherein said oxidizer channel and said gaseous fuel channel exhibit a V-shaped configuration, said oxidizer channel and said gaseous fuel channel being closest together at said burner block face.

4. The apparatus of claim 2 wherein said oxidizer channel and said gaseous fuel channel exhibit a substantially parallel configuration.

5. The apparatus of claim 2 wherein said oxidizer channel and said gaseous fuel channel have a predetermined angle therebetween, said angle being within the range of 0 to approximately 90 degrees.

6. A method of combustion for a burner assembly having an oxidizer channel, a gaseous fuel channel and an exit face at which said oxidizer channel and said gaseous fuel channel terminate, said oxidizer channel and said gaseous fuel channel each having a central longitudinal axis, said method comprising the steps of:

providing a supply oxidizer flow stream;

separating said supply oxidizer flow stream into a primary oxidizer flow stream and a secondary oxidizer flow stream;

regulating the flow of said primary oxidizer flow stream and said secondary oxidizer flow stream;

injecting said primary oxidizer flow stream into said oxidizer channel such that said primary oxidizer flow stream flows along the central longitudinal axis of said oxidizer channel;

injecting said secondary oxidizer flow stream into said oxidizer channel such that said secondary oxidizer flow stream surrounds said primary oxidizer flow stream and recombines with said primary oxidizer flow stream adjacent said exit face to create a recombined oxidizer flow stream;

providing a supply gaseous fuel flow stream;

separating said supply gaseous fuel flow stream into a primary gaseous fuel flow stream and a secondary gaseous fuel flow stream;

regulating the flow of said primary gaseous fuel flow stream and said secondary gaseous fuel flow stream;

injecting said primary gaseous fuel flow stream into said gaseous fuel channel such that said primary gaseous fuel flow stream flows along the central longitudinal axis of said gaseous fuel channel;

injecting said secondary gaseous fuel flow stream into said gaseous fuel channel such that said secondary gaseous fuel flow stream surrounds said primary gaseous fuel flow stream and recombines with said primary gaseous fuel flow stream adjacent said exit face to create a recombined gaseous fuel flow stream, and combining said recombined oxidizer fuel flow stream with said recombined gaseous fuel flow stream after said recombined oxidizer fuel flow stream and said recombined gaseous fuel flow stream fuel exit said exit face to cause combustion.

* * * * *